US011127347B2

(12) United States Patent
Huang et al.

(10) Patent No.: US 11,127,347 B2
(45) Date of Patent: Sep. 21, 2021

(54) PIXEL CIRCUIT, DRIVING METHOD THEREOF AND DISPLAY PANEL

(71) Applicants: BOE TECHNOLOGY GROUP CO., LTD., Beijing (CN); MIANYANG BOE OPTOELECTRONICS TECHNOLOGY CO., LTD., Sichuan (CN)

(72) Inventors: Yinglong Huang, Beijing (CN); Bingwei Yang, Beijing (CN); Wenbao Gao, Beijing (CN)

(73) Assignees: MIANYANG BOE OPTOELECTRONICS TECHNOLOGY CO., LTD., Mianyang (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/649,283

(22) PCT Filed: Sep. 24, 2019

(86) PCT No.: PCT/CN2019/107530
§ 371 (c)(1),
(2) Date: Mar. 20, 2020

(87) PCT Pub. No.: WO2020/140489
PCT Pub. Date: Jul. 9, 2020

(65) Prior Publication Data

US 2021/0134219 A1 May 6, 2021

(30) Foreign Application Priority Data

Jan. 2, 2019 (CN) ..... 201910001300.4

(51) Int. Cl.
*G09G 3/3233* (2016.01)

(52) U.S. Cl.
CPC ... *G09G 3/3233* (2013.01); *G09G 2300/0426* (2013.01); *G09G 2300/0842* (2013.01)

(58) Field of Classification Search
CPC ..... G09G 3/3233; G09G 2300/0426; G09G 2300/0842
See application file for complete search history.

(56) References Cited

U.S. PATENT DOCUMENTS 8,803,770 B2 8/2014 Jeong et al.
9,040,974 B2 5/2015 Park et al.
(Continued)

FOREIGN PATENT DOCUMENTS

CN 102314829 A 1/2012
CN 104218056 A 12/2014
(Continued)

*Primary Examiner* — Stacy Khoo
(74) *Attorney, Agent, or Firm* — Westman, Champlin & Koehler, P.A.

(57) ABSTRACT

Embodiments of the present disclosure provide a pixel circuit, a driving method thereof, and a display panel. The pixel circuit comprises: a light-emitting element; a driving sub-circuit configured to generate a current for driving the light-emitting element to emit light; and a first and a second light emission controlling sub-circuit, configured to supply the current for driving the light-emitting element to emit light to a first terminal of the light-emitting element under a control of a first controlling signal, respectively; a driving controlling sub-circuit configured to provide a data signal to the driving sub-circuit under a control of a second controlling signal; and the resetting sub-circuit configured to reset the driving sub-circuit, the first terminal of the light-emitting element, and a second node with a first voltage, under a control of a first resetting signal and a second resetting signal.

17 Claims, 14 Drawing Sheets

(56) References Cited

U.S. PATENT DOCUMENTS

| | | | | |
|---|---|---|---|---|
| 10,249,238 | B2 | 4/2019 | Ko et al. | |
| 10,262,594 | B2 | 4/2019 | Ma | |
| 10,650,751 | B2 | 5/2020 | Zou et al. | |
| 2011/0164018 | A1 | 7/2011 | Kang et al. | |
| 2012/0001893 | A1 | 1/2012 | Jeong et al. | |
| 2014/0353616 | A1 | 12/2014 | Park et al. | |
| 2018/0190185 | A1 | 7/2018 | Ko et al. | |
| 2018/0301092 | A1 | 10/2018 | Ma | |
| 2019/0073955 | A1 | 3/2019 | Zou et al. | |
| 2019/0228706 | A1* | 7/2019 | Umeda | G09G 3/3233 |
| 2019/0304371 | A1 | 10/2019 | Li | |
| 2020/0082757 | A1 | 3/2020 | Yuan et al. | |

FOREIGN PATENT DOCUMENTS

| | | | |
|---|---|---|---|
| CN | 104575377 | A | 4/2015 |
| CN | 105427803 | A | 3/2016 |
| CN | 105679236 | A | 6/2016 |
| CN | 106531077 | A | 3/2017 |
| CN | 107358918 | A | 11/2017 |
| CN | 107358920 | A | 11/2017 |
| CN | 108492782 | A | 9/2018 |
| CN | 109119027 | A | 1/2019 |

* cited by examiner

PIXEL CIRCUIT, DRIVING METHOD THEREOF AND DISPLAY PANEL

CROSS-REFERENCE TO RELATED APPLICATION(S)

This application is a Section 371 National Stage Application of International Application No. PCT/CN2019/107530, which has not yet published, and claims priority of Chinese Patent Application No. 201910001300.4, filed on Jan. 2, 2019, the disclosures of which are hereby incorporated by reference in their entireties.

TECHNICAL FIELD

The present disclosure relates to the field of display technology. In particular, the present disclosure relates to a pixel circuit, a driving method thereof and a display panel.

BACKGROUND

In an OLED (Organic Light-Emitting Diode) display panel, an afterimage may occur due to a hysteresis effect of a driving transistor. It is tried to improve the influence of the afterimage by changing a pattern and thickness of a gate insulating layer, a doping content of a polysilicon layer, and a quality of an interface between the two layers, but the result is not effective enough.

SUMMARY

Embodiments of the present disclosure provide a pixel circuit and a method for driving the same, and a display panel.

According to one aspect of the embodiments of the present disclosure, there is provided a pixel circuit, comprising: a light-emitting element; a driving sub-circuit configured to generate a current for driving the light-emitting element to emit light; a first light emission controlling sub-circuit and a second light emission controlling sub-circuit, wherein the first light emission controlling sub-circuit is electrically coupled to the driving sub-circuit at a first node, and the second light emission controlling sub-circuit is electrically connected between the driving sub-circuit and a first terminal of the light-emitting element, and is electrically coupled to the driving sub-circuit at a second node, and wherein the first light emission controlling sub-circuit and the second light emission controlling sub-circuit are configured to receive a first controlling signal, and supply the current for driving the light-emitting element to emit light to the first terminal of the light-emitting element under a control of the first controlling signal; a driving controlling sub-circuit electrically coupled to the driving sub-circuit, and configured to receive a data signal and a second controlling signal, and supply the data signal to the driving sub-circuit under a control of the second controlling signal; and a resetting sub-circuit electrically coupled to the driving sub-circuit, and configured to receive a first voltage signal, a first resetting signal, and a second resetting signal, and reset the driving sub-circuit, the first terminal of the light-emitting element, and the second node with the first voltage signal under a control of the first resetting signal and the second resetting signal.

In some embodiments, the driving sub-circuit comprises a driving transistor, a first transistor, and a storage capacitor. A gate of the driving transistor is electrically coupled to a third node, a first electrode of the driving transistor is electrically coupled to the first node, and a second electrode of the driving transistor is electrically coupled to the second node; a gate of the first transistor is electrically coupled to receive a third controlling signal, a first electrode of the first transistor is electrically coupled to the third node, and a second electrode of the first transistor is electrically coupled to the second node; and a first electrode of the storage capacitor is electrically coupled to receive a second voltage signal, and a second electrode of the storage capacitor is electrically coupled to the third node.

In some embodiments, the resetting sub-circuit comprises a second transistor, a third transistor, and a fourth transistor. A gate of the second transistor is electrically coupled to receive the first resetting signal, a first electrode of the second transistor is electrically coupled to receive the first voltage signal, and a second electrode of the second transistor is electrically coupled to the third node; a gate of the third transistor is electrically coupled to receive the second resetting signal, a first electrode of the third transistor is electrically coupled to receive the first voltage signal, and a second electrode of the third transistor is electrically coupled to a first terminal of the light-emitting element; and a gate of the fourth transistor is electrically coupled to receive the first resetting signal, the first electrode of the fourth transistor is electrically coupled to receive the first voltage signal, and the second electrode of the fourth transistor is electrically coupled to the second node.

In some other embodiments, the resetting sub-circuit comprises a second transistor and a third transistor, wherein a gate of the second transistor is electrically coupled to receive the first resetting signal, a first electrode of the second transistor is electrically coupled to receive the first voltage signal, and a second electrode of the second transistor is electrically coupled to the second node; a gate of the third transistor is electrically coupled to receive the second resetting signal, a first electrode of the third transistor is electrically coupled to receive the first voltage signal, and a second electrode of the third transistor is electrically coupled to the first terminal of the light-emitting element.

In some embodiments, the first light emission controlling sub-circuit comprises a fifth transistor, and the second light emission controlling sub-circuit comprises a sixth transistor. A gate of the fifth transistor is electrically coupled to receive the first controlling signal, a first electrode of the fifth transistor is electrically coupled to receive the second voltage signal, and a second electrode of the fifth transistor is electrically coupled to the first node; and a gate of the sixth transistor is electrically coupled to receive the first controlling signal, a first electrode of the sixth transistor is electrically coupled to the second node, and a second electrode of the sixth transistor is electrically coupled to the first terminal of the light-emitting element.

In some embodiments, the driving controlling sub-circuit comprises a seventh transistor. A gate of the seventh transistor is electrically coupled to receive the second controlling signal, a first electrode of the seventh transistor is electrically coupled to receive the data signal, and a second electrode of the seventh transistor is electrically coupled to the first node.

In some embodiments, the resetting sub-circuit is configured to charge a voltage at the first node to a sum of a threshold voltage corresponding to the driving sub-circuit and a voltage of the first voltage signal, by using the first voltage signal.

In some embodiments, the first resetting signal is the same as the second resetting signal.

In some other embodiments, the second resetting signal is the same as the first resetting signal being delayed by half a clock cycle.

According to another aspect of the disclosure, there is provided a display panel, comprising: a plurality of scanning lines; a plurality of data lines, arranged to be intersected with the plurality of scanning lines; and a plurality of pixel units arranged at the intersections of respective data line and respective scanning line as a matrix, and electrically coupled to corresponding data line and corresponding scanning line, wherein each of the plurality of pixel units comprises the pixel circuit of any one of embodiments discussed above. The data signal received by the pixel circuit is supplied by the corresponding data line of the pixel unit, and the second controlling signal received by the pixel circuit is supplied by the corresponding scanning line of the pixel unit.

In some embodiments, the display panel further comprises a plurality of light emission controlling lines. The plurality of light emission controlling lines are arranged in parallel with the plurality of scanning lines or the plurality of data lines, and electrically coupled to the same pixel unit as the plurality of scanning lines or the plurality of data lines respectively. The first controlling signal and the third controlling signal received by the pixel circuit are supplied by a corresponding light emission controlling line of the pixel unit.

In some embodiments, the first resetting signal and the second resetting signal received by the pixel circuit are supplied by a scanning line previous to a corresponding scanning line of the pixel unit in a scanning order.

According to another aspect of the embodiments of the disclosure, there is provided a method for driving the pixel circuit of any one of embodiments discussed above. The method comprises: supplying, during a first period, a first controlling signal, a second controlling signal and a third controlling signal of a first level, and a first resetting signal and a second resetting signal of a second level; supplying, during a second period, the first controlling signal, the first resetting signal, and the second resetting signal of the first level, and the second controlling signal and the third controlling signal of the second level, or the first controlling signal, the third controlling signal, the first resetting signal, and the second resetting signal of the first level, and the second controlling signal of the second level; supplying, during a third period, the second controlling signal, the third controlling signal, the first resetting signal, and the second resetting signal of the first level, and the first controlling signal of the second level, or the second controlling signal, the first resetting signal, and the second resetting signal of the first level, and the first controlling signal and the third controlling signal of the second level.

In some embodiments, the voltage at the first node is charged to a sum of a threshold voltage corresponding to the driving sub-circuit and a voltage of the first voltage signal, by using the first voltage signal.

According to yet another aspect of the embodiments of the present disclosure, there is provided a display panel including a plurality of pixel units, at least one of the plurality of pixel units comprising the pixel circuit of the embodiments discussed above. Each of the at least one pixel unit comprises: a substrate; the first transistor, the third transistor, the fourth transistor, and the sixth transistor, each of which comprises: an active layer comprising a first electrode area and a second electrode region, and a channel area between the first electrode area and the second electrode area; a first insulating layer covering the active layer; a gate layer disposed on the first insulating layer to be electrically insulated from the active layer; and a second insulating layer covering the gate layer and the first insulating layer; a shield connection layer comprising a first shield line and a second shield line, the first shield line electrically connecting the second electrode area of the third transistor with the second electrode area of the sixth transistor, and the second shield line electrically connecting the second electrode area of the fourth transistor with the first electrode area of the sixth transistor. At least one of the first and second shield lines has an orthographic projection on the substrate at least partially overlapping with an orthographic projection of the channel area of the first transistor on the substrate.

In some embodiments, the third transistor is formed with a first through hole penetrating the first insulating layer and the second insulating layer of the third transistor, so as to expose a part of the second electrode area of the third transistor; the sixth transistor is formed with a second through hole and a third through hole penetrating the first insulating layer and the second insulating layer of the sixth transistor, so as to expose a part of the first electrode area of the sixth transistor and a part of the second electrode area of the sixth transistor, respectively; and the fourth transistor is formed with a fourth through hole penetrating the first insulating layer and the second insulating layer of the fourth transistor, so as to expose a part of the second electrode area of the fourth transistor, wherein the first shield line electrically connects the second electrode area of the third transistor with the second electrode area of the sixth transistor through the first through hole and the third through hole, and the second shield line electrically connects the second electrode area of the fourth transistor with the first electrode area of the sixth transistor through the second through hole and the fourth through hole.

BRIEF DESCRIPTION OF THE DRAWINGS

In order to illustrate the technical solutions of the embodiments of the present disclosure more clearly, the drawings that are used in the description of the embodiments of the present disclosure will be briefly explained below. Obviously, the drawings in the following description are just some embodiments of the present disclosure. It should be apparent for those skilled in art that other drawings can also be obtained based on these drawings without creative efforts, in which.

DETAILED DESCRIPTION

Figure 1:
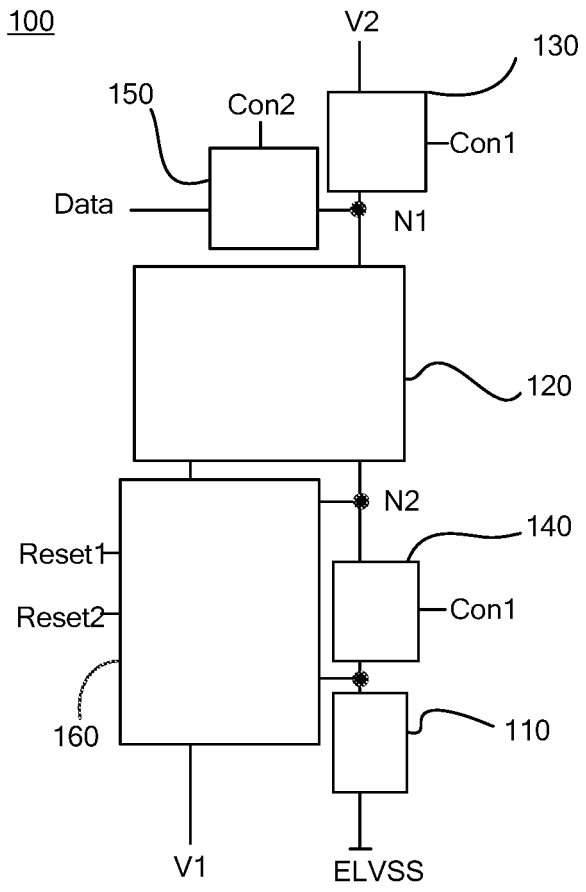
FIG. 1 shows a schematic block diagram of a pixel circuit according to an embodiment of the present disclosure.

In order to make the objectives, technical solutions, and advantages of the embodiments of the present disclosure more clear, the technical solutions of the embodiments of the present disclosure will be described clearly and completely in combination with the drawings in the embodiments of the present disclosure. Obviously, the described embodiments are part of the disclosure, but not all. Based on the described embodiments of the present disclosure, other embodiments which are obtained by those skilled in the art without creative efforts should all belong to the scope of the present disclosure. It should be noted that the same or similar reference numeral refers to the same element throughout the drawings. In the following description, some specific embodiments are used for descriptive purposes only and should not be construed as any limitation to the present disclosure, but merely as examples of the embodiments of the present disclosure. Conventional structures or constructions will be omitted once they may obscure the understanding of the present disclosure. It should be noted that the shapes and sizes of the components in the drawings do not reflect the true size and proportion, but merely illustrate the content of the embodiments of the present disclosure.

The technical terms or scientific terms used in the embodiments of the present disclosure shall have ordinary meanings as understood by those skilled in the art. The terms such as "first", "second", and the like used in the embodiments of the present disclosure do not indicate any order, quantity, or importance, but are only used to distinguish one element from another element.

Furthermore, in the description of the embodiments of the present disclosure, the term "electrically coupled" may refer to two components being electrically connected directly, or may refer to two components being electrically connected via one or more other components. In addition, these two components can be electrically connected or coupled in a wired or wireless way.

The transistors used in the embodiments of the present disclosure may all be thin film transistors or field effect transistors or other devices with the same characteristics. Depending on their roles in the circuit, the transistors used in the embodiments of the present disclosure are mainly switching transistors. Since the source and drain of the thin film transistor used herein are symmetrical, the source and drain can be interchanged. In the embodiment of the present disclosure, one of the source and the drain is referred to as a first electrode, and the other of the source and the drain is referred to as a second electrode. In the following example, the driving transistor is described as a P-type thin film transistor, and other transistors have the same or different type as the driving transistor according to the circuit design. Similarly, in other embodiments, the driving transistor may be illustrated as an N-type thin film transistor. In this case, it should be understood by those skilled in the art that the technical solution of the present disclosure can also be implemented by changing the types of other transistors accordingly, and inverting the driving signals and level signals (and/or making other additional adaptive modifications).

In addition, in the description of the embodiments of the present disclosure, the terms, such as "first level" and "second level", are only used to distinguish between two levels with different amplitudes. In some embodiments, the "first level" may be a high level and the "second level" may be a low level. Hereinafter, since the driving transistor is exemplified as a P-type thin film transistor, the "first level" is exemplified as a high level, and the "second level" is exemplified as a low level.

Hereinafter, the embodiments of the present disclosure will be described in detail with reference to the drawings.

FIG. 1 shows a schematic block diagram of a pixel circuit 100 according to an embodiment of the present disclosure.

As shown in FIG. 1, the pixel circuit 100 may include a light-emitting element 110, a driving sub-circuit 120, a first light emission controlling sub-circuit 130, a second light emission controlling sub-circuit 140, a driving controlling sub-circuit 150, and a resetting sub-circuit 160.

The light-emitting element 110 may be any light-emitting element driven by a current, such as an OLED or AMOLED light-emitting element. The light-emitting element 110 includes a first terminal and a second terminal. The first terminal is electrically coupled to the second light emission controlling sub-circuit 140, and the second terminal is electrically coupled to a constant voltage terminal ELVSS. In some embodiments, the first terminal is an anode of the light-emitting element 110, and the second end is a cathode of the light-emitting element 110.

The driving sub-circuit 120 generates a current for driving the light-emitting element 110 to emit light.

The first light emission controlling sub-circuit 130 is electrically connected between a second voltage line and the driving sub-circuit 120, and is electrically coupled to the driving sub-circuit 120 at a first node N1. The first light emission controlling sub-circuit 130 is configured to receive a first controlling signal Con1, receive a second voltage V2 from the second voltage line under the control of the first controlling signal Con1, and apply the second voltage V2 to the driving sub-circuit 120. In some embodiments, the second voltage V2 may be a power supply voltage ELVDD. In some embodiments, ELVDD is higher than the first level (i.e., the high level). In some embodiments, the first controlling signal Con1 is illustrated as a light emission controlling signal.

The second light emission controlling sub-circuit 140 is electrically connected between the driving sub-circuit 120 and the first terminal of the light-emitting element 110, and is electrically coupled to the driving sub-circuit 120 at the second node N2. The second light emission controlling sub-circuit 140 is configured to receive the first controlling signal Con1 and supply the current for driving the light-emitting element 110 to emit light, which is generated by the driving sub-circuit 120, to the first terminal of the first light-emitting element 110, under the control of the first controlling signal Con1.

The driving controlling sub-circuit 150 is electrically connected between the data voltage line and the driving sub-circuit 120, and is configured to receive a second controlling signal Con2. By the control of the second controlling signal Con2, the driving controlling sub-circuit 150 is controlled to supply the data signal Data from the data voltage line to the driving sub-circuit 120. In some embodiments, the second controlling signal Con2 is exemplified as a gate driving signal.

In some embodiments, the driving controlling sub-circuit 150 and the first light emission controlling sub-circuit 130 are both electrically coupled to the driving sub-circuit 120 at the first node N1.

The resetting sub-circuit 160 is electrically connected between the first voltage line and the driving sub-circuit 120, and is configured to receive a first resetting signal Reset1 and a second resetting signal reset2. The resetting sub-circuit 160 is configured to reset the driving sub-circuit 120, the first terminal of the light-emitting element 110, and the second node N2 with the first voltage V1 from the first voltage line, under a control of the first resetting signal Reset1 and the second resetting signal Reset2. In some embodiments, the first voltage V1 may have a second level. In some embodiments, the first resetting signal Reset1 is, for example, a gate driving signal for the pixel units of a previous row in a scanning order.

In some embodiments, the first resetting signal Reset1 is the same as the second resetting signal Reset2. In other embodiments, the second resetting signal Reset2 is the same as the first resetting signal Reset1 being delayed by half a clock cycle, that is, the second resetting signal Reset2 is behind the first resetting signal Reset1 by half a clock cycle. Those skilled in the art should understand that the clock cycle corresponds to the cycle of the clock signal in the gate driving circuit for driving the pixel circuit. The gate driving circuit provides a gate driving signal, for example, the second controlling signal Con2 in the embodiment being exemplified as the gate driving signal.

In the embodiment of the present disclosure, the second node N2 is reset simultaneously with the driving sub-circuit 120 by using the resetting sub-circuit 160, so that the driving sub-circuit 120 has a fixed initial state before being written with the data signal Data, so as to achieve an improvement for the phenomena of short-term afterimages.

Figure 2:
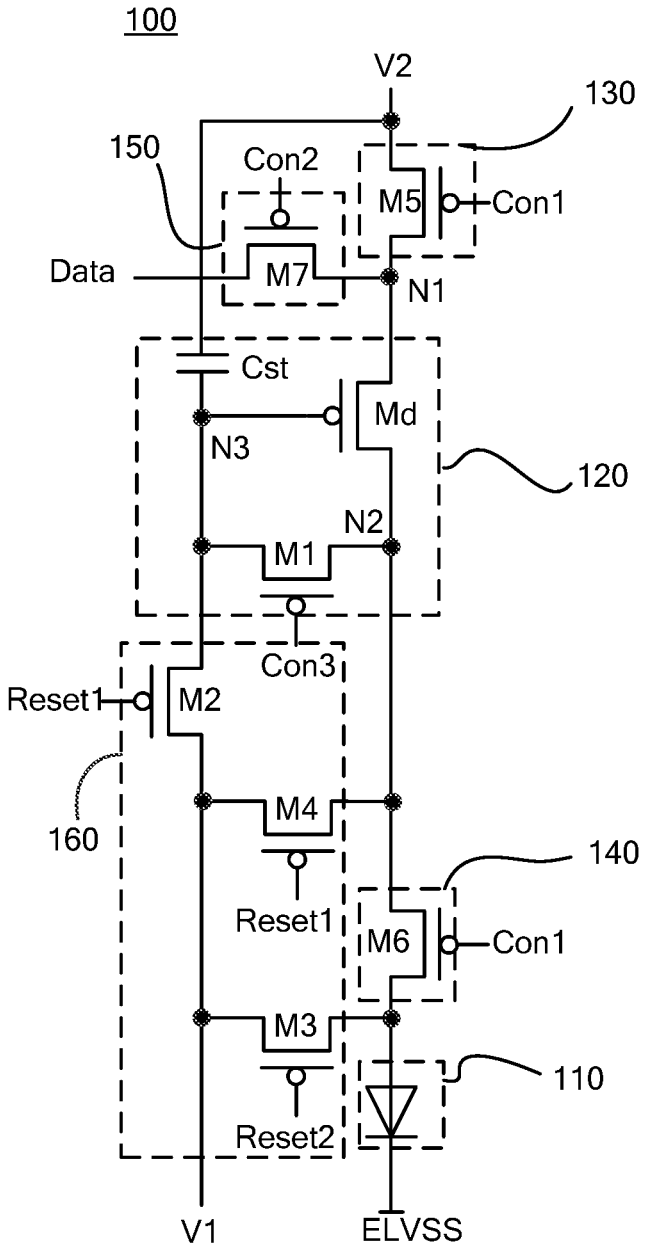
FIG. 2 shows an example structure of the pixel circuit of FIG. 1.

FIG. 2 shows an example structure of the pixel circuit 100 of FIG. 1.

As shown in FIG. 2, the driving sub-circuit 120 may include a driving transistor Md, a first transistor M1, and a storage capacitor Cst.

A gate of the driving transistor Md is electrically coupled to a third node N3, a first electrode of the driving transistor is electrically coupled to the first light emission controlling sub-circuit 130 at the first node N1, and a second electrode of the driving transistor is electrically coupled to the second light emission controlling sub-circuit 140 at the second node N2. In some embodiments, the first electrode of the driving transistor Md is the source, and the second electrode of the driving transistor is the drain.

A gate of the first transistor M1 is electrically coupled to receive a third controlling signal Con3, a first electrode of the first transistor is electrically coupled to a third node N3, and a second electrode of the first transistor is electrically coupled to the second node N2.

The first electrode of the storage capacitor Cst is electrically coupled to a second voltage line so as to the second voltage V2, and a second electrode of the storage capacitor is electrically coupled to the third node N3.

The first transistor M1 and the driving transistor Md may be a P-type transistor or an N-type transistor. In the exemplary embodiment, the description is made on the assumption that the driving transistor Md is a P-type transistor. In the exemplary embodiment, the first transistor M1 is exemplified as a P-type transistor.

The resetting sub-circuit 160 includes a second transistor M2, a third transistor M3, and a fourth transistor M4.

A gate of the second transistor M2 is electrically coupled to receive the first resetting signal Reset1, a first electrode of the second transistor is electrically coupled to the first voltage line so as to receive the first voltage V1, and a second electrode of the second transistor is electrically coupled to the third node N3.

A gate of the third transistor M3 is electrically coupled to receive the second resetting signal Reset2, a first electrode of the third transistor is electrically coupled to the first voltage line so as to receive the first voltage V1, and a second electrode of the third transistor is electrically coupled to a first terminal of the light-emitting element 110.

A gate of the fourth transistor M4 is electrically coupled to receive the first resetting signal Reset1, the first electrode of the fourth transistor M4 is electrically coupled to the first voltage line so as to receive the first voltage V1, and the second electrode of the fourth transistor M4 is electrically coupled to the second node N2.

The second transistor M2, the third transistor M3, and the fourth transistor M4 may be P-type transistors or N-type transistors. In the exemplary embodiment, the second transistor M2, the third transistor M3, and the fourth transistor M4 are exemplified as P-type transistors.

The first light emission controlling sub-circuit 130 includes a fifth transistor M5, and the second light emission controlling sub-circuit 140 includes a sixth transistor M6.

Specifically, a gate of the fifth transistor M5 is electrically coupled to receive the first controlling signal Con1, a first electrode of the fifth transistor is electrically coupled to the second voltage line so as to receive the second voltage V2, and a second electrode of the fifth transistor is electrically coupled to the first node N1.

A gate of the sixth transistor M6 is electrically coupled to receive the first controlling signal Con1, a first electrode of the sixth transistor is electrically coupled to the second node N2, and a second electrode of the sixth transistor is electrically coupled to the first terminal of the light-emitting element 110.

The fifth transistor M5 and the sixth transistor M6 may be P-type transistors or N-type transistors. In the exemplary embodiment, the fifth transistor M5 and the sixth transistor M6 are exemplified as P-type transistors.

The drive controlling sub-circuit 150 includes a seventh transistor M7.

A gate of the seventh transistor M7 is electrically coupled to receive the second controlling signal Con2, a first electrode of the seventh transistor is electrically coupled to the data voltage line so as to receive the data signal Data, and a second electrode of the seventh transistor is electrically coupled to the first node N1.

The seventh transistor may be a P-type transistor or an N-type transistor. In the exemplary embodiment, the seventh transistor M7 is exemplified as a P-type transistor.

Figure 3A:
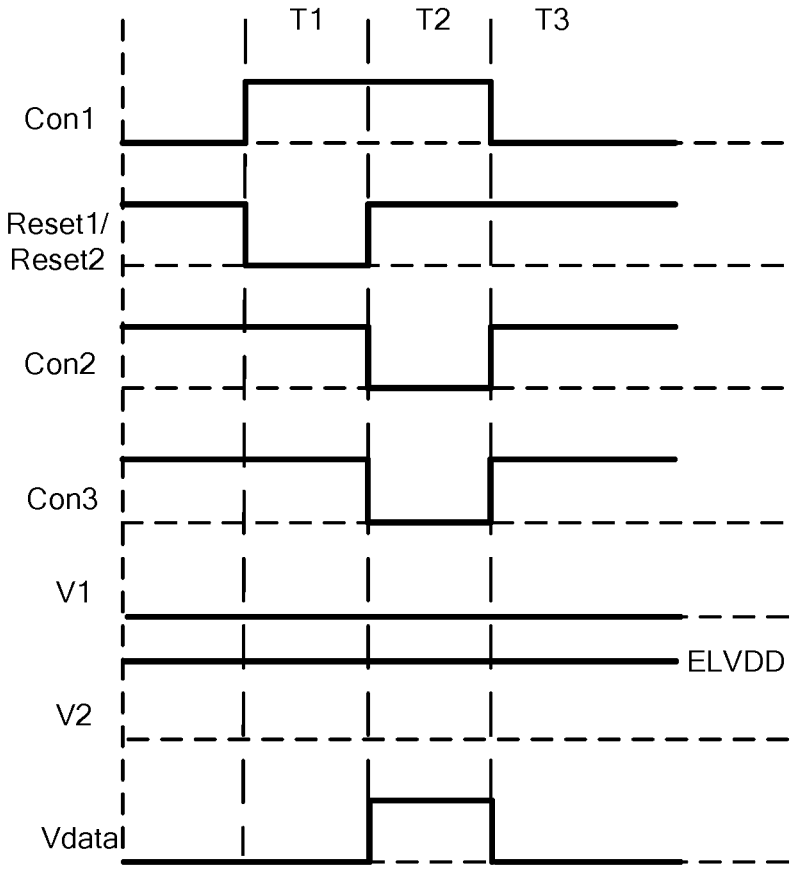
FIG. 3A shows a signal timing diagram of the pixel circuit of FIG. 2.

FIG. 3A shows a signal timing diagram of the pixel circuit 100 of FIG. 2.

For example, referring to FIG. 3A, during a first period T1, a first controlling signal Con1, a second controlling signal Con2 and a third controlling signal Con3 of a first level (i.e. high level), and a first resetting signal Reset1 and a second resetting signal Reset2 of a second level (i.e. low level) are supplied. In the embodiment shown in FIGS. 3A-3D, the description is made on the assumption that the second resetting signal Reset2 is the same as the first resetting signal Reset1. In other embodiments, since the second resetting signal Reset2 is used to control the resetting of the first terminal of the light-emitting element 110, and such resetting will not have a substantial influence on the afterimage removal and the light-emitting effect as long as it occurs before a light-emitting period (i.e., a third period T3). Thus, those skilled in the art would understand that the embodiment of the present disclosure can also be implemented in a case where the second resetting signal Reset2 is behind the first resetting signal Reset1 by half a clock cycle.

Figure 3B:
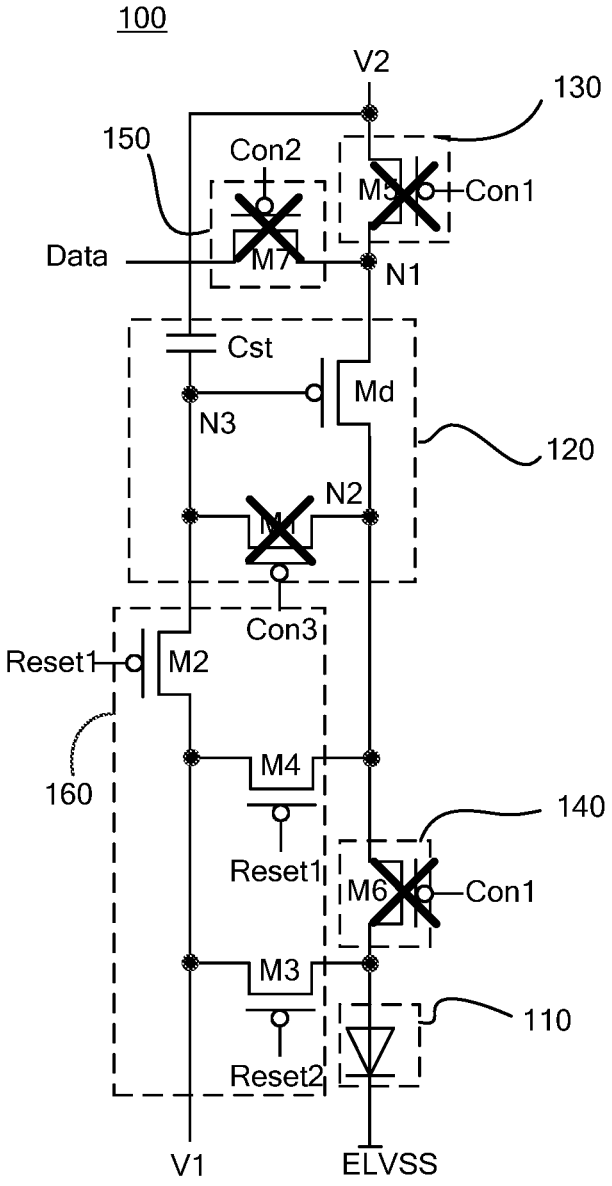
FIG. 3B to FIG. 3D are schematic diagrams illustrating the principle of respective periods of the pixel circuit of FIG. 2.

Accordingly, during the first period T1, under the control of the first controlling signal Con1, the fifth transistor M5 and the sixth transistor M6 are turned off. Under the control of the second controlling signal Con2, the seventh transistor M7 is turned off. Under the control of the third controlling signal Con3, the first transistor M1 is turned off. Under the control of the first resetting signal Reset1, the second transistor M2 and the fourth transistor M4 are turned on. Under the control of the second resetting signal Reset2 (in this embodiment, being the same as Reset1), the third transistor M3 is turned on. At this time, the principle schematic diagram of the pixel circuit 100 is shown in FIG. 3B. It should be noted that the turned off transistors during this period in FIG. 3B are marked with diagonal crosses "x".

As shown in FIG. 3B, in a case where the second transistor M2, the third transistor M3, and the fourth transistor M4 are turned on, the first voltage V1 of the low level is applied to the third node N3, the second node N2, and the first terminal of the light-emitting element 110, so that the gate of the driving transistor Md becomes a low level V1. The driving transistor Md is turned on, and the low level V1 continues to charge the first node N1 through the driving transistor Md, until the voltage at the first node N1 becomes Vs=V1+Vth, wherein Vth is the threshold voltage of Md. At this time, the driving transistor Md is in an off-bias state, and Vgs equals a fixed value minus Vth. The voltage at the second node N2 is stabilized at V1. The first terminal (for example, the anode) of the light-emitting element 110 is also reset to the low level V1. Accordingly, the second electrode of the driving transistor Md and the anode of the light-emitting element 110 are both reset to the low level V1. Therefore, the first period T1 is also referred to as a "resetting period".

During a second period T2, the first controlling signal Con1, the first resetting signal Reset1, and the second resetting signal Reset2 of the first level (i.e. high level), and the second controlling signal Con2 and the third controlling signal Con3 of the second level (i.e. low level) are supplied.

Figure 3C:
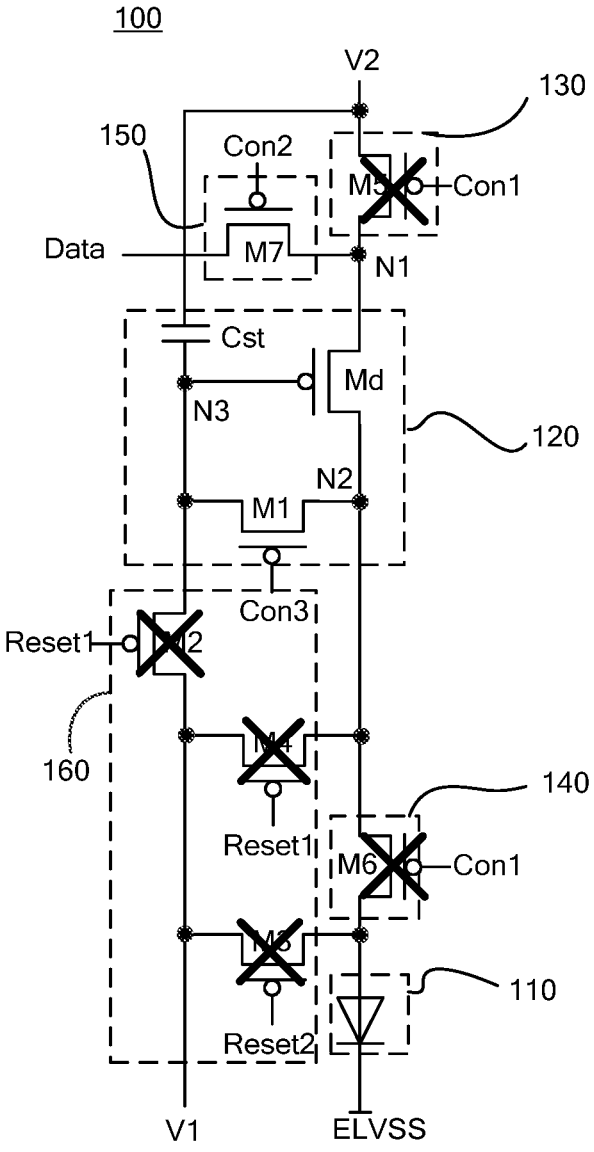

Accordingly, during the second period T2, under the control of the first controlling signal Con1, the fifth transistor M5 and the sixth transistor M6 are turned off. Under the control of the second controlling signal Con2, the seventh transistor M7 is turned on. Under the control of the third controlling signal Con3, the first transistor M1 is turned on. Under the control of the first resetting signal Reset1, the second transistor M2 and the fourth transistor M4 are turned off. Under the control of the second resetting signal Reset2, the third transistor M3 is turned off. At this time, the principle schematic diagram of the pixel circuit 100 is shown in FIG. 3C. It should be noted that the turned off transistors during this period in FIG. 3C are marked with diagonal crosses "x".

As shown in FIG. 3C, when the seventh transistor M7 is turned on, the data signal Data of a high-level (with a voltage of Vdata) is applied to the first node N1, so that the voltage at the first node N1 increases to the high level from V1+Vth at the end of the resetting period T1. The driving transistor Md changes from the off-biased state to an on-bias state, and the driving transistor Md is turned on, so that the data signal Data of the high level continues to be applied to the second node N2. When the first transistor M1 is turned on, the data signal Data of the high level is continuously applied to the third node N3, and charges the third node N3 of the low level. With an increase of the voltage at the third node N3, the gate-source voltage Vgs of the driving transistor Md gradually increases from V1−Vdata, until Vgs=−Vth. At this time, the driving transistor Md returns to the off-bias state, and meanwhile stops charging the third node N3. At this time, the voltage at the third node N3 (that is, the gate of Md) is given by Vg=Vgs+Vs=Vdata−Vth. The voltage Vdata of the data signal Data has been written into the third node N3. Therefore, this second period T2 may also be referred to as a "data voltage writing period". In some embodiments, Vdata may have a first level.

During a third period T3, the second controlling signal Con2, the third controlling signal Con3, the first resetting signal Reset1, and the second resetting signal Reset2 of the first level (i.e. high level), and the first controlling signal Con1 of the second level (i.e. low level) are supplied.

Figure 3D:
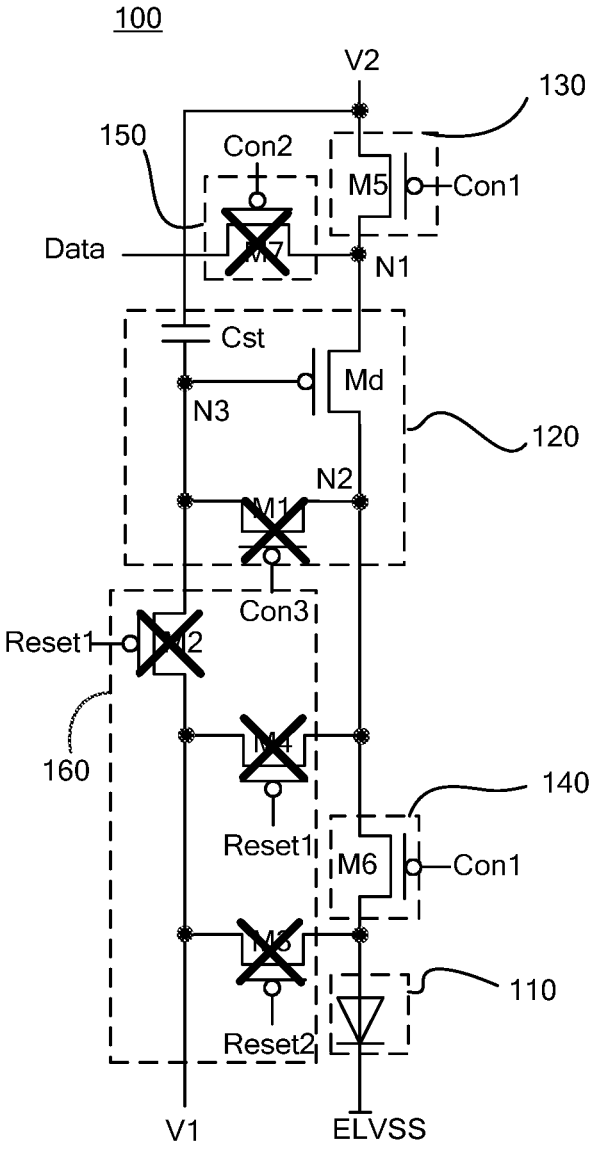

Accordingly, during a third period T3, under the control of the first controlling signal Con1, the fifth transistor M5 and the sixth transistor M6 are turned on. Under the control of the second controlling signal Con2, the seventh transistor M7 is turned off. Under the control of the third controlling signal Con3, the first transistor M1 is turned off. Under the control of the first resetting signal Reset1, the second transistor M2 and the fourth transistor M4 are turned off. Under the control of the second resetting signal Reset2, the third transistor M3 is turned off. At this time, the principle schematic diagram of the pixel circuit 100 is shown in FIG. 3D. It should be noted that the turned off transistors during this period in FIG. 3D are marked by diagonal crosses "x".

As shown in FIG. 3D, when the fifth transistor M5 is turned on, the second voltage V2 (i.e., ELVDD) is applied to the first node N1, that is, the source voltage Vs of the driving transistor Md equals to ELVDD. At this time, since the first transistor M1, the third transistor, and the fourth transistor M4 are all turned off, the third node N3 cannot be charged. Therefore, the voltage at the third node N3 is maintained at Vdata−Vth, that is, the gate voltage of the driving transistor Md, Vg=Vdata−Vth. At this time, Vgs=Vdata−Vth−ELVDD, which is less than −Vth (since ELVDD is greater than Vdata), so that the driving transistor Md is turned on. When the sixth transistor M6 is turned on, the driving current Id generated by the driving transistor Md is applied to the anode of the light-emitting element 110 and drives the light-emitting element to emit light. Therefore, the third period T3 is also referred to as a "light-emitting period".

For example, the driving current Id is given by:

$$\begin{aligned} I_d &= K\cdot(Vsg - Vth)^2 \\ &= K\cdot(Vth + ELVDD - Vdata - Vth)^2 \\ &= K\cdot(ELVDD - Vdata)^2 \end{aligned}$$

Among others, K is a current constant associated with the driving transistor Md, which is related to process parameters and geometric dimensions of the driving transistor Md. It can be known from the above formula that the driving current Id for driving the light-emitting element 110 to emit light is independent of the threshold voltage Vth of the driving transistor Md, thereby eliminating the phenomenon of uneven brightness of the light-emitting elements caused by the difference in the threshold voltage Vth of the driving transistors Md. In addition, during the driving process, after the resetting period terminates, Vgs is enabled to be maintained at a fixed value by resetting the second node N2, which can effectively suppress the afterimage.

Figure 4:
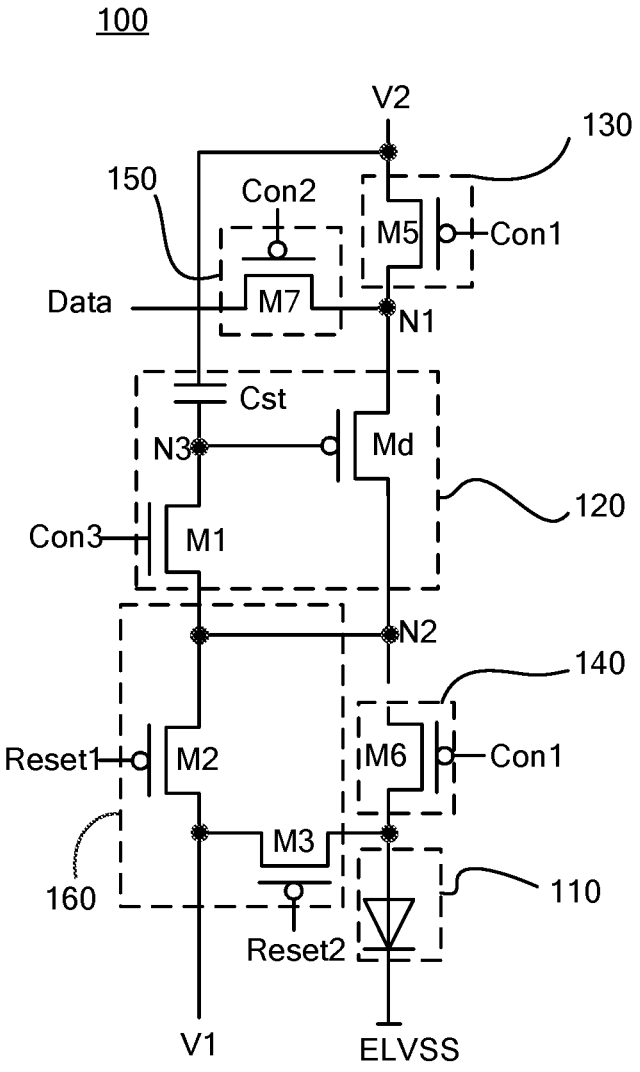
FIG. 4 shows another example structure of the pixel circuit of FIG. 1.

FIG. 4 shows another example structure of the pixel circuit 100 of FIG. 1. The structure of the pixel circuit of FIG. 4 is different from the structure of FIG. 2 in that the first transistor M1 is a different type of transistor and has different connection relationships, and the resetting sub-circuit does not include the fourth transistor M4.

Specifically, as shown in FIG. 4, the driving sub-circuit 120 includes a driving transistor Md, a first transistor M1, and a storage capacitor Cst.

The gate of the driving transistor Md is electrically coupled to the third node N3, the first electrode of the driving transistor is electrically coupled to the first light emission controlling sub-circuit 130 at the first node N1, and a second electrode of the driving transistor is electrically coupled to the second light emission controlling sub-circuit 140 at the second node N2. In some embodiments, the first electrode of the driving transistor Md is the source and the second electrode is the drain.

The gate of the first transistor M1 is electrically coupled to receive the third controlling signal Con3, the first electrode of the first transistor M1 is electrically coupled to the third node N3, and the second electrode of the first transistor M1 is electrically coupled to the second node N2.

The first terminal of the storage capacitor Cst is electrically coupled to the second voltage line so as to receive the second voltage V2, and the second electrode of the storage capacitor Cst is electrically coupled to the third node N3.

The first transistor M1 and the driving transistor Md may be P-type transistors or N-type transistors. In the exemplary embodiment, the description will be made on the assumption that the driving transistor Md is a P-type transistor. In the exemplary embodiment, the first transistor M1 is exemplified as an N-type transistor.

The resetting sub-circuit 160 includes a second transistor M2 and a third transistor M3.

The gate of the second transistor M2 is electrically coupled to receive the first resetting signal Reset1, the first electrode of the second transistor is electrically coupled to the first voltage line so as to receive the first voltage V1, and the second electrode of the second transistor is electrically coupled to the second node N2.

The gate of the third transistor M3 is electrically coupled to receive the second resetting signal Reset2, the first electrode of the third transistor is electrically coupled to the first voltage line so as to receive the first voltage V1, and the second electrode of the third transistor is electrically coupled to the first terminal of the light-emitting element 110.

The second transistor M2 and the third transistor M3 may be P-type transistors or N-type transistors. In the exemplary embodiment, the second transistor M2 and the third transistor M3 are exemplified as P-type transistors.

The first light emission controlling sub-circuit 130 includes a fifth transistor M5, and the second light emission controlling sub-circuit 140 includes a sixth transistor M6.

For example, the gate of the fifth transistor M5 is electrically coupled to receive the first controlling signal Con1, the first electrode of the fifth transistor is electrically coupled to the second voltage line so as to receive the second voltage V2, and the second electrode of the fifth transistor is electrically coupled to the first node N1.

The gate of the sixth transistor M6 is electrically coupled to receive the first controlling signal Con1, the first electrode of the sixth transistor is electrically coupled to the second node N2, and the second electrode of the sixth transistor is electrically coupled to the first terminal of the light-emitting element 110.

The fifth transistor M5 and the sixth transistor M6 may be P-type transistors or N-type transistors. In the exemplary embodiment, the fifth transistor M5 and the sixth transistor M6 are exemplified as P-type transistors.

The drive controlling sub-circuit 150 includes a seventh transistor M7.

The gate of the seventh transistor M7 is electrically coupled to receive the second controlling signal Con2, the first electrode of the seventh transistor is electrically coupled to the data voltage line so as to receive the data signal Data, and the second electrode of the seventh transistor is electrically coupled to the first node N1.

The seventh transistor M7 may be a P-type transistor or an N-type transistor. In the exemplary embodiment, the seventh transistor M7 is exemplified as a P-type transistor.

Figure 5A:
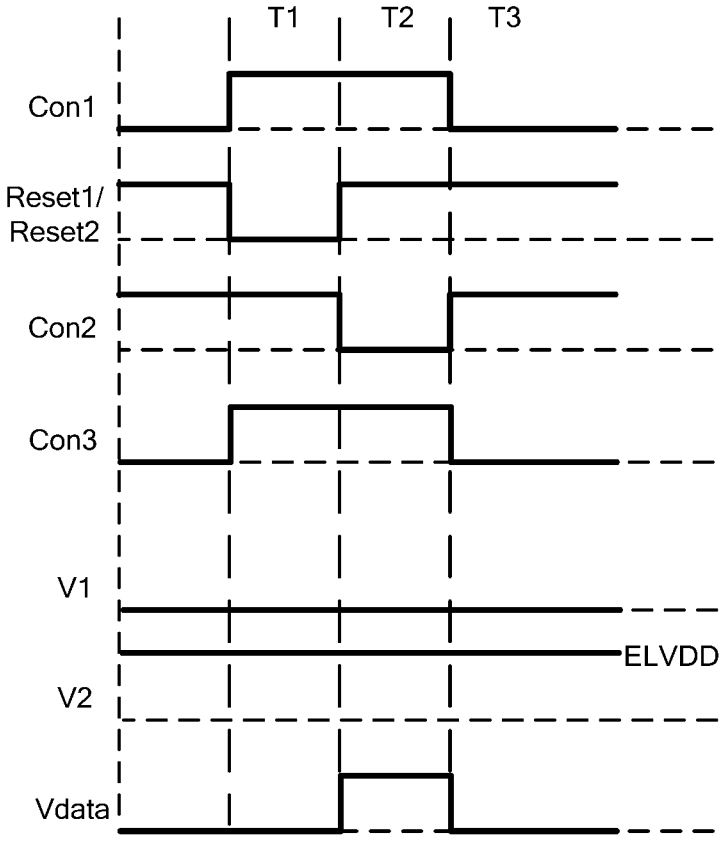
FIG. 5A shows a signal timing diagram of the pixel circuit of FIG. 4.

FIG. 5A shows a signal timing diagram of the pixel circuit 100 of FIG. 4.

Specifically, referring to FIG. 5A, during a first period T1, a first controlling signal Con1, a second controlling signal Con2 and a third controlling signal Con3 of a first level (i.e. high level), and a first resetting signal Reset1 and a second resetting signal Reset2 of a second level (i.e. low level) are supplied. In the embodiment shown in FIGS. 5A-5D, the description is made on the assumption that the second resetting signal Reset2 is the same as the first resetting signal Reset1. In other embodiments, since the second resetting signal Reset2 is used to control the resetting of the first terminal of the light-emitting element 110, and such resetting will not have a substantial influence on the afterimage removal and the light-emitting effect as long as it occurs before a light-emitting period (i.e., a third period T3), those skilled in the art would understand that the embodiment of the present disclosure can also be implemented in a case where the second resetting signal Reset2 is behind the first resetting signal Reset1 by half a clock cycle.

Figure 5B:
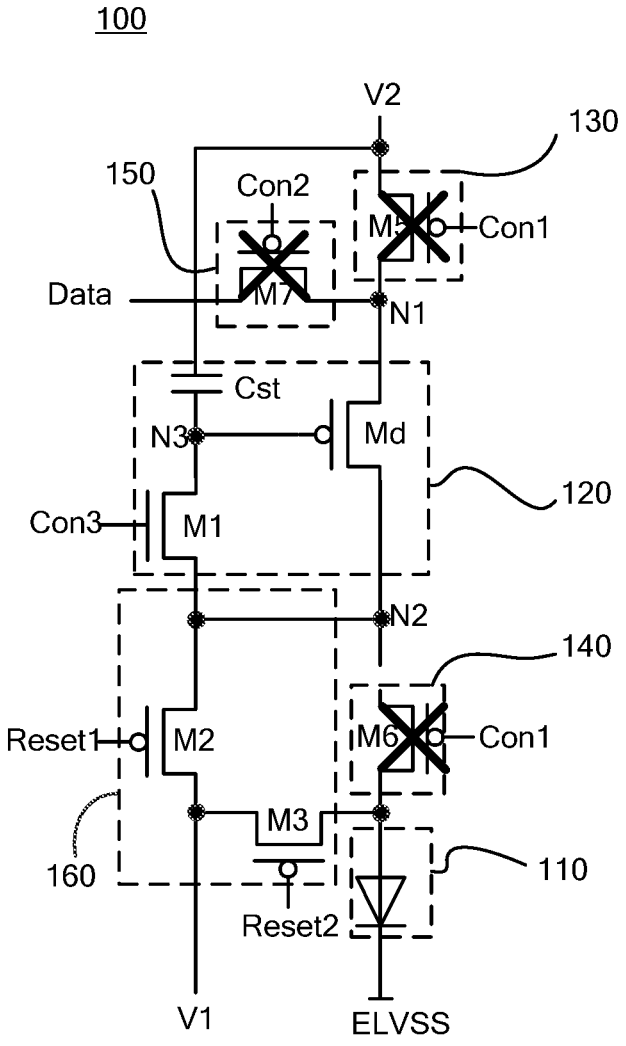
FIG. 5B to FIG. 5D are schematic diagrams illustrating the principle of respective periods of the pixel circuit of FIG. 4.

Accordingly, during the first period T1, under the control of the first controlling signal Con1, the fifth transistor M5 and the sixth transistor M6 are turned off. Under the control of the second controlling signal Con2, the seventh transistor M7 is turned off. Under the control of the first resetting signal Reset1, the second transistor M2 is turned on. Under the control of the second resetting signal Reset2 (in this embodiment, being the same as Reset1), the third transistor M3 is turned on. At this time, the principle schematic diagram of the pixel circuit 100 is shown in FIG. 5B. It should be noted that the turned off transistors during this period in FIG. 5B are marked with diagonal crosses "x".

As shown in FIG. 5B, in a case where the first transistor M1, the second transistor M2 and the third transistor M3 are turned on, the first voltage V1 of the low level is applied to the third node N3, the second node N2, and the first terminal of the light-emitting element 110, so that the gate of the driving transistor Md becomes a low level V1. The driving transistor Md is turned on, and the low level V1 continues to charge the first node N1 through the driving transistor Md, until the voltage at the first node N1 becomes Vs=V1+Vth, wherein Vth is the threshold voltage of Md. At this time, the driving transistor Md is in an off-bias state, and Vgs equals a fixed value minus Vth. The voltage at the second node N2 is stabilized at V1. The first terminal (for example, the anode) of the light-emitting element 110 is also reset to the low level V1. Accordingly, the second electrode of the driving transistor Md and the anode of the light-emitting element 110 are both reset to the low level V1. Therefore, the first period T1 is also referred to as a "resetting period".

During a second period T2, the first controlling signal Con1, the third controlling signal Con3, the first resetting signal Reset1, and the second resetting signal Reset2 of the first level (i.e. high level), and the second controlling signal Con2 of the second level (i.e. low level) is supplied.

Figure 5C:
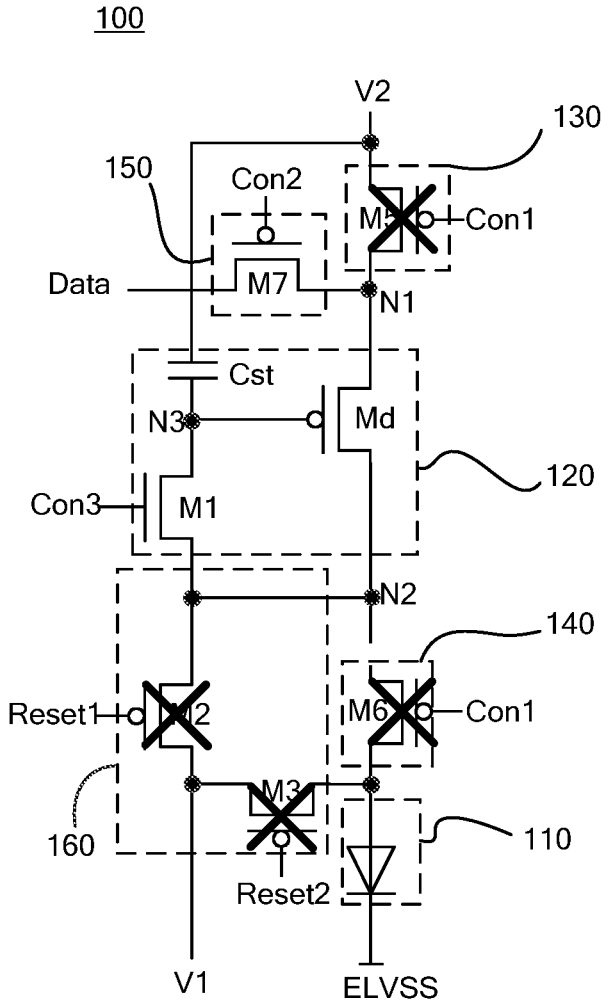

Accordingly, during the second period T2, under the control of the first controlling signal Con1, the fifth transistor M5 and the sixth transistor M6 are turned off. Under the control of the third controlling signal Con3, the first transistor M1 is turned on. Under the control of the second controlling signal Con2, the seventh transistor M7 is turned on. Under the control of the first resetting signal Reset1, the second transistor M2 is turned off. Under the control of the second resetting signal Reset2, the third transistor M3 is turned off. At this time, the principle schematic diagram of the pixel circuit 100 is shown in FIG. 5C. It should be noted that the turned off transistors during this period in FIG. 5C are marked with diagonal crosses "x".

As shown in FIG. 5C, when the seventh transistor M7 is turned on, the data signal Data of a high-level (with a voltage of Vdata) is applied to the first node N1, so that the voltage at the first node N1 increases to the high level from V1+Vth at the end of the resetting period T1. The driving transistor Md changes from the off-biased state to an on-bias state, and the driving transistor Md is turned on, so that the data signal Data of the high level continues to be applied to the second node N2. When the first transistor M1 is turned on, the data signal Data of the high level is continuously applied to the third node N3, and charges the third node N3 of the low level. With an increase of the voltage at the third node N3, the gate-source voltage Vgs of the driving transistor Md gradually increases from V1−Vdata, until Vgs=−Vth. At this time, the voltage at the third node N3 (that is, the gate of Md) is given by Vg=Vgs+Vs=Vdata−Vth. The voltage Vdata of the data signal Data has been written into the third node N3. Therefore, this second period T2 may also be referred to as a "data voltage writing period". In some embodiments, Vdata may have a first level.

During a third period T3, the second controlling signal Con2, the first resetting signal Reset1, and the second resetting signal Reset2 of the first level (i.e. high level), and the first controlling signal Con1 and the third controlling signal Con3 of the second level (i.e. low level) are supplied.

Figure 5D:
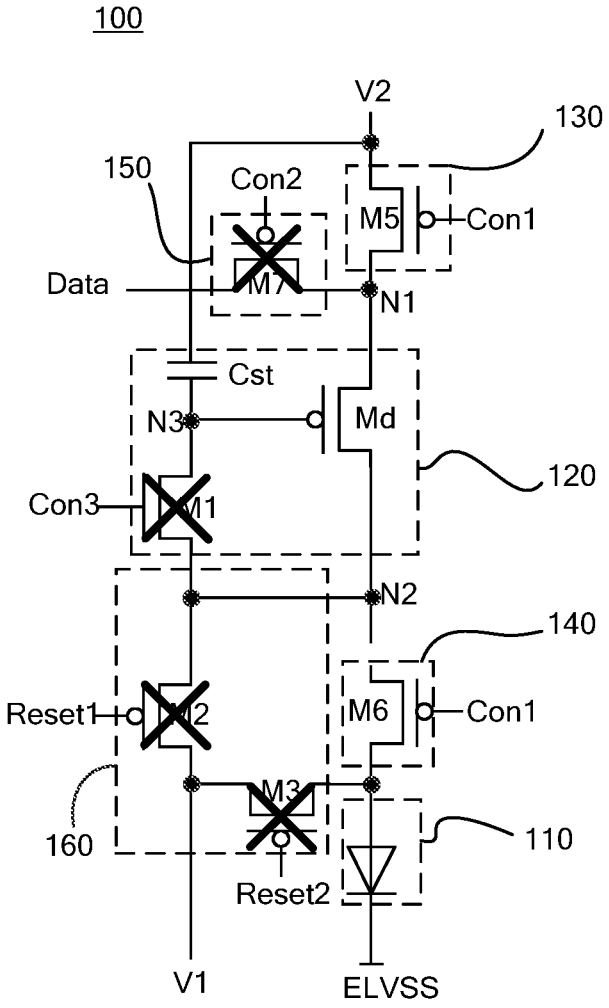

Accordingly, during a third period T3, under the control of the first controlling signal Con1, the fifth transistor M5 and the sixth transistor M6 are turned on. Under the control of the second controlling signal Con2, the seventh transistor M7 is turned off. Under the control of the third controlling signal Con3, the first transistor M1 is turned off. Under the control of the first resetting signal Reset1, the second transistor M2 is turned off. Under the control of the second resetting signal Reset2, the third transistor M3 is turned off. At this time, the principle schematic diagram of the pixel circuit 100 is shown in FIG. 5D. It should be noted that the turned off transistors during this period in FIG. 5D are marked by diagonal crosses "x".

As shown in FIG. 5D, when the fifth transistor M5 is turned on, the second voltage V2 (i.e., ELVDD) is applied to the first node N1, that is, the source voltage Vs of the driving transistor Md equals to ELVDD. At this time, since the first transistor M1 is turned off, the third node N3 cannot be charged. Therefore, the voltage at the third node N3 is maintained at Vdata−Vth, that is, the gate voltage of the driving transistor Md, Vg=Vdata−Vth. At this time, Vgs=Vdata−Vth−ELVDD, which is less than −Vth (since ELVDD is greater than Vdata), so that the driving transistor Md is turned on. When the sixth transistor M6 is turned on, the driving current Id generated by the driving transistor Md is applied to the anode of the light-emitting element 110 and drives the light-emitting element to emit light. Therefore, the third period T3 is also referred to as a "light-emitting period".

For example, the driving current Id is given by:

$$\begin{aligned} I_d &= K\cdot(Vsg - Vth)^2 \\ &= K\cdot(Vth + ELVDD - Vdata - Vth)^2 \\ &= K\cdot(ELVDD - Vdata)^2 \end{aligned}$$

Among others, K is a current constant associated with the driving transistor Md, which is related to process parameters and geometric dimensions of the driving transistor Md. It can be known from the above formula that the driving current Id for driving the light-emitting element 110 to emit light is independent of the threshold voltage Vth of the driving transistor Md, thereby eliminating the phenomenon of uneven brightness of the light-emitting elements caused by the difference in the threshold voltage Vth of the driving transistors Md. In addition, during the driving process, after the resetting period terminates, Vgs is enabled to be maintained at a fixed value by resetting the second node N2, which can effectively suppress the afterimage.

Figure 6:
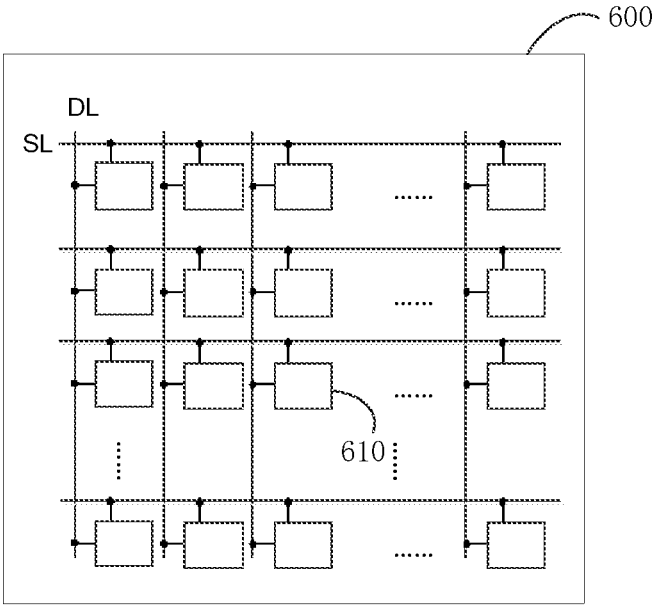
FIG. 6 shows a schematic block diagram of a display panel according to an embodiment of the present disclosure.

FIG. 6 shows a schematic block diagram of a display panel 600 according to an embodiment of the present disclosure. As shown in FIG. 6, the display panel 600 may include a plurality of scanning lines SL, a plurality of data lines DL, and a plurality of pixel units 610. The plurality of data lines DL and the plurality of scanning signal lines SL are arranged to be intersected with each other, and the plurality of pixel units 610 are arranged at the intersections of respective data line and respective scanning line as a matrix, and electrically coupled to corresponding data line DL and corresponding scanning line SL. Each of the plurality of pixel units 610 is provided with the pixel circuit according to the embodiments of the present disclosure, such as, the pixel circuit 100 shown in FIG. 1, FIG. 2, or FIG. 4.

In some embodiments, the data voltage line electrically coupled to the pixel circuit 100 is implemented with the corresponding data line DL of the pixel unit 610, and the second controlling signal Con2 received by the pixel circuit 100 is provided by the corresponding scanning line SL of the pixel unit 610.

In some embodiments, the display panel 600 may further include a plurality of light emission controlling lines (not shown in FIG. 6). The plurality of light emission controlling lines are arranged in parallel with the plurality of scanning lines SL or the plurality of data lines DL, and electrically coupled to the same pixel unit as the plurality of scanning lines SL or the plurality of data lines DL respectively.

In some embodiments, the first controlling signal Con1 and the third controlling signal Con3 received by the pixel circuit 100 are supplied by a corresponding light emission controlling line of the pixel unit 610.

In some embodiments, the first resetting signal Reset1 and the second resetting signal Reset2 received by the pixel circuit 100 are supplied by a scanning line SL previous to a corresponding scanning line SL of the pixel unit 610 in a scanning order.

Figure 7:
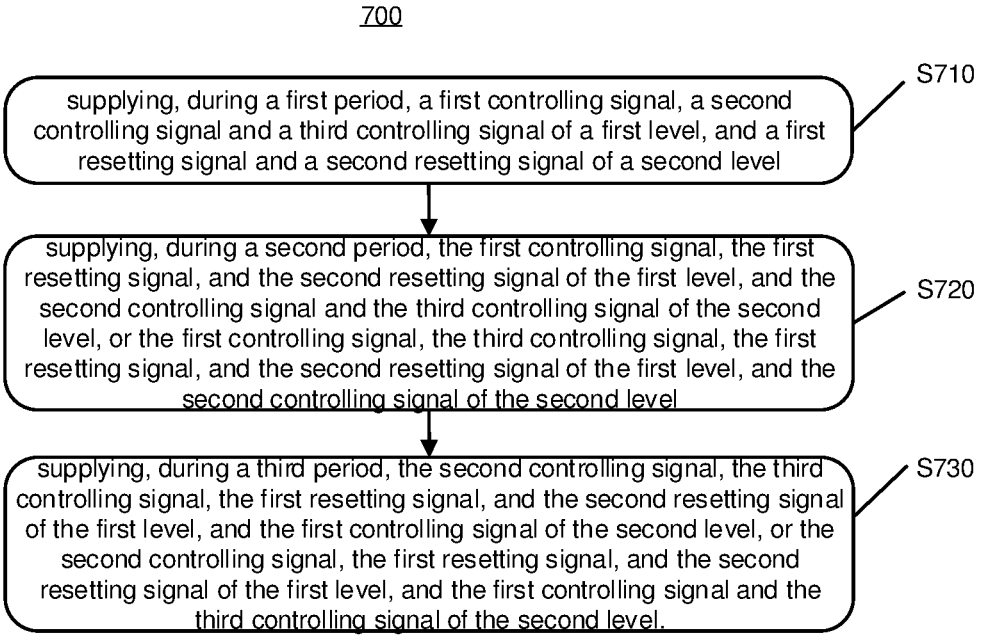
FIG. 7 shows a flowchart illustrating a method for driving a pixel circuit according to an embodiment of the present disclosure.

FIG. 7 shows a flowchart illustrating a method 700 for driving a pixel circuit according to an embodiment of the present disclosure. The driving method 700 may be used to drive the pixel circuit 100 shown in FIG. 1, FIG. 2, or FIG. 4.

As shown in FIG. 7, in step S710, during a first period, a first controlling signal, a second controlling signal and a third controlling signal of a first level, and a first resetting signal and a second resetting signal of a second level are supplied.

In step S720, during a second period, the first controlling signal, the first resetting signal, and the second resetting signal of the first level, and the second controlling signal and the third controlling signal of the second level are supplied, or the first controlling signal, the third controlling signal, the first resetting signal, and the second resetting signal of the first level, and the second controlling signal of the second level are supplied.

In step S730, during a third period, the second controlling signal, the third controlling signal, the first resetting signal, and the second resetting signal of the first level, and the first controlling signal of the second level are supplied, or the second controlling signal, the first resetting signal, and the second resetting signal of the first level, and the first controlling signal and the third controlling signal of the second level are supplied.

Among them, the first level is, for example, a high level, which is a turn off level with respect to a P-type transistor, i.e. capable of turning off the relevant switching transistor; a turn on level with respect to an N-type transistor, i.e. capable of turning on the relevant switching transistor. The second level is, for example, a low level, which is a turn on level with respect to a P-type transistor, i.e. capable of turning on the relevant switching transistor; a turn off level with respect to an N-type transistor, i.e. capable of turning off the relevant switching transistor.

The driving processes of the method 700 implemented in different embodiments are described above with reference to FIG. 2 and FIG. 4. Thus, the details are not described herein again.

According to an embodiment of the present disclosure, there is further provided a display panel including a plurality of pixel units, and at least one of the plurality of pixel units includes the pixel circuit 100 of the embodiment shown in FIG. 2. An example layout and layered structure of respective transistor in the pixel circuit 100 of the embodiment shown in FIG. 2 are described below with reference to FIGS. 8 to 11.

Figure 8:
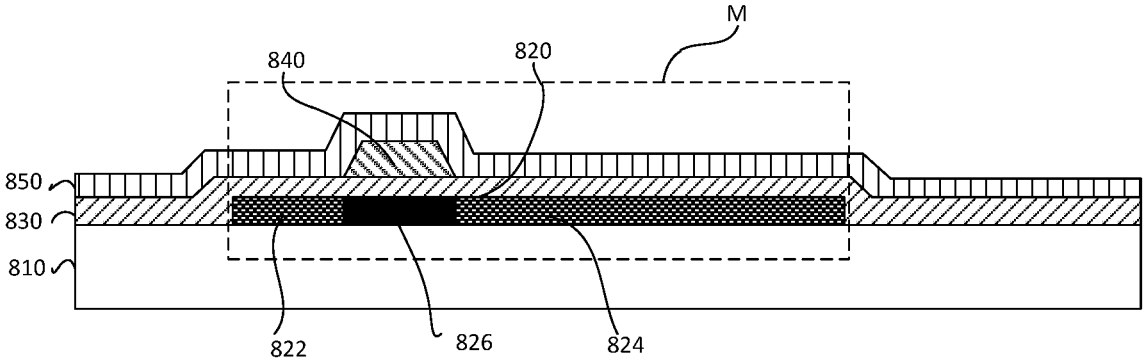
FIG. 8 shows a schematic diagram illustrating an example structure of a transistor in the pixel circuit according to an embodiment of the present disclosure.

FIG. 8 shows a schematic diagram illustrating an example structure of a transistor M in the pixel circuit according to an embodiment of the present disclosure. Each transistor in the above embodiments can be implemented with the transistor M shown in FIG. 8.

As shown in FIG. 8, the pixel unit includes a substrate 810 and a transistor M disposed on the substrate 810. The transistor M includes an active layer 820, a first insulating layer 830, a gate layer 840, and a second insulating layer 850.

The active layer 820 includes a first electrode area 822 and a second electrode region 824, and a channel area 826 between the first electrode area 822 and the second electrode area 824.

The first insulating layer 830 covers the active layer 820.

The gate layer 840 is disposed on the first insulating layer 830, and the gate layer 840 is electrically insulated from the active layer 820.

The second insulating layer 850 covers the gate layer 840 and the first insulating layer 830.

Figure 9:
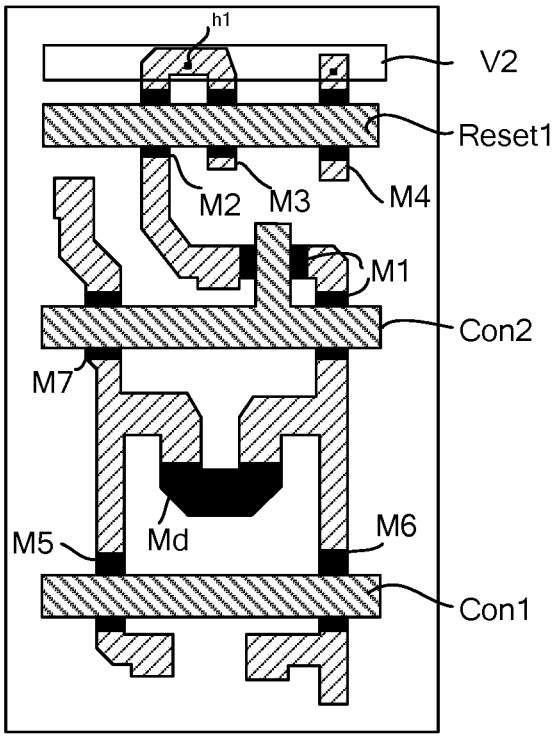
FIG. 9 shows a schematic diagram illustrating an example layout of respective transistors of the pixel circuit of FIG. 2 on a display panel.

FIG. 9 shows a schematic diagram illustrating an example layout of respective transistors of the pixel circuit 100 of FIG. 2 on a display panel, wherein each transistor has a structure as illustrated in FIG. 8. For the convenience of explanation and understanding, only the channel area is shown for each transistor in FIG. 9 (shown by a black filled pattern, which is the same as the illustrated pattern of the channel area 826 of the transistor M shown in FIG. 8), so as to indicate the location of the transistor.

It should be noted that FIG. 9 assumes that the second resetting signal Reset2 is the same as the first resetting signal Reset1, and the third controlling signal Con3 is the same as the second controlling signal Con2. In order to facilitate the understanding of the positional relationship between respective transistors, the structure of the storage capacitor Cst is omitted.

FIG. 9 indicates a first voltage line for providing a first voltage V1 by a translucent scattered dot pattern, and a controlling signal line for providing controlling signals Reset1, Con1, and Con2 by a diagonal right-dash pattern, wherein these controlling signal lines can be set in the same layer. The second voltage line may be disposed on the same layer or a different layer from these controlling signal lines.

As shown in FIG. 9, the second transistor M2, the third transistor M3, and the fourth transistor M4 are arranged on the upper portion of the pixel unit, and one of their terminals (for example, the first electrodes) is electrically coupled to the first voltage line via a through hole (for example, h1).

The first transistor M1 and the seventh transistor M7 are arranged in the middle portion of the pixel unit, and the fifth transistor M5 and the sixth transistor M6 are arranged in the lower part of FIG. 9. In some embodiments, as shown in FIG. 9, the first transistor M1 has a double-gate structure.

On the basis of the layout shown in FIG. 9, in order to realize the structure of the pixel circuit shown in FIG. 2, it is required to electrically connect the second electrode of the third transistor M3 with the second electrode of the sixth transistor M6, and to electrically connect the second electrode of the four transistor M4 with the first electrode of the sixth transistor M6.

Figure 10:
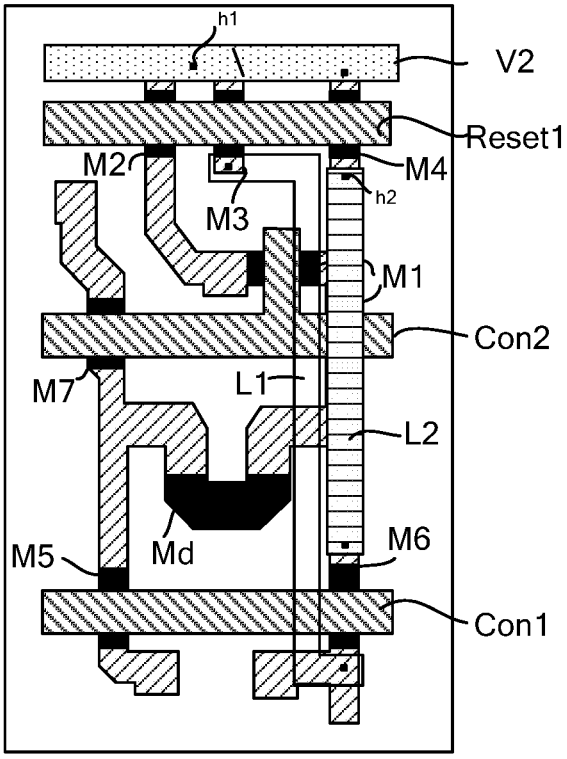
FIG. 10 shows a schematic diagram illustrating an example layout with a first shield line and a second shield line.

FIG. 10 shows an embodiment in which the above connection is implemented by using a first shield line L1 and a second shield line L2. Among them, the first shield line L1 and the second shield line L2 are located in the shield connection layer and are translucently shown by a horizontal line pattern. The first shield line L1 is electrically coupled to the second electrode of the third transistor M3 and the second electrode of the sixth transistor M6 via holes (for example, h2) at both ends thereof. The second shield line L2 is electrically coupled to the second electrode of the fourth transistor M4 and the first electrode of the sixth transistor M6 via holes at both ends thereof.

As shown in FIG. 10, the second shield line L2 and the first transistor M1 at least partially overlap with each other, so as to shield at least a part of the first transistor M1. That is, the orthographic projection of the second shield line L2 on the substrate of the display panel and the orthographic projection of the channel area of the first transistor M1 on the substrate at least partially overlap with each other.

The shield line is made of a conductor (for example, a metal). Thus, when the current passes through the shield line, a parasitic capacitance will be induced between the shield line and the transistor. Therefore, on one hand, the shielding of M1 by the above-mentioned shielding line can shield M1 well, thereby avoiding the influence of temperature and illumination on M1. On the other hand, it can also reduce the leakage current of M1 and make the light-emitting current more stable.

In addition, in some embodiments, the first shield line L1 may also be configured to cover at least a part of the first transistor M1. As shown in FIG. 10, the first shield line L1 also at least partially overlaps the channel area of the first transistor M1.

In the example layouts of FIGS. 9 and 10, the third transistor M3 is located to the left of the fourth transistor M4. However, it should be understood that in other embodiments, the positions of the two transistors are interchangeable.

Figure 11:
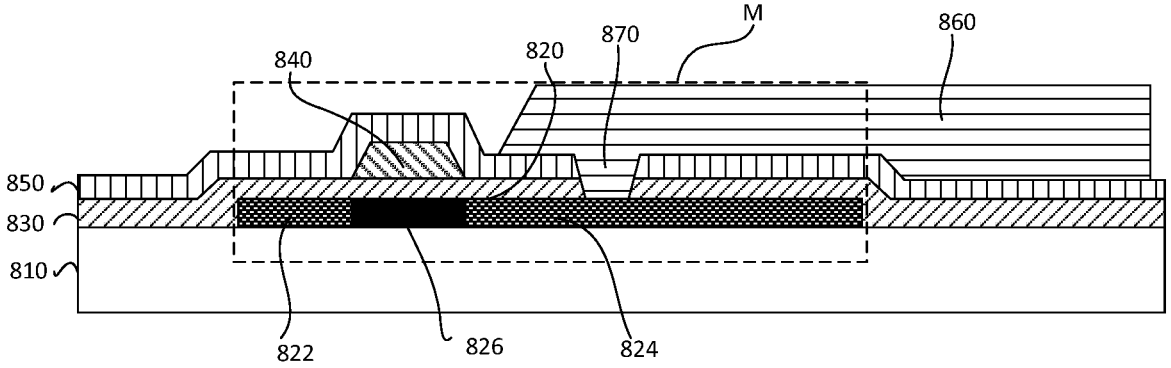
FIG. 11 shows a structural diagram including an electrical connection between a shield connection layer and a transistor.

FIG. 11 shows a structural diagram including an electrical connection between a shield connection layer and a transistor. FIG. 11 is drawn on the basis of FIG. 8. Compared with FIG. 8, a shield connection layer 860 is further formed on the second insulating layer 850. The shield connection layer 860 may include a first shield line L1 and a second shield line L2.

The shield connection layer 860 is electrically coupled to the second electrode area 824 of the third transistor M3 via the through hole 870 (i.e., the through hole h2) penetrating the first insulating layer 830 and the second insulating layer 850 of the third transistor M3. The electrical connections between the first shield line L1 and the second electrode area of the third transistor M3 and the second electrode area of the sixth transistor M6, and the electrical connections between the second shield line L2 and the second electrode area of the fourth transistor M4 and the first electrode area of the sixth transistor M6 can be implemented with the structure shown in FIG. 11.

For example, the third transistor M3 may be formed with a first through hole penetrating the first insulating layer and the second insulating layer of the third transistor M3, so as to expose a part of the second electrode area of the third transistor M3; the sixth transistor M6 is formed with a second through hole and a third through hole penetrating the first insulating layer and the second insulating layer of the sixth transistor M6, so as to expose a part of the first electrode area of the sixth transistor M6 and a part of the second electrode area of the sixth transistor M6, respectively; and the fourth transistor M4 is formed with a fourth through hole penetrating the first insulating layer and the second insulating layer of the fourth transistor M4, so as to expose a part of the second electrode area of the fourth transistor M4.

The first shield line L1 electrically connects the second electrode area of the third transistor M3 with the second electrode area of the sixth transistor M6 through the first through hole and the third through hole, and the second shield line L2 electrically connects the second electrode area of the fourth transistor M4 with the first electrode area of the sixth transistor M6 through the second through hole and the fourth through hole.

The foregoing detailed description has set forth numerous embodiments by using schematic diagrams, flowcharts, and/or examples. When such schematic diagrams, flowcharts, and/or examples include one or more functions and/or operations, those skilled in the art should understand that each function and/or operation in these schematic diagrams, flowcharts, or examples may be implemented by various structures, hardware, software, firmware, or any combination thereof individually and/or collectively.

Although the present disclosure has been described with reference to several exemplary embodiments, it should be understood that the terminology used herein is illustrative and exemplary, and not restrictive. Since the present disclosure can be embodied in various forms without departing from the spirit or essence of the disclosure, it should be understood that the above embodiments are not limited to any of the foregoing details, but should be broadly interpreted within the spirit and scope defined by the appended claims. Therefore, all changes and modifications falling within the scope of the claims or their equivalents shall be included by the appended claims.

We claim:

1. A pixel circuit, comprising:

a light-emitting element;

a driving sub-circuit configured to generate a current for driving the light-emitting element to emit light;

a first light emission controlling sub-circuit and a second light emission controlling sub-circuit, wherein the first light emission controlling sub-circuit is electrically coupled to the driving sub-circuit at a first node, and the second light emission controlling sub-circuit is electrically connected between the driving sub-circuit and a first terminal of the light-emitting element, and is electrically coupled to the driving sub-circuit at a second node, and wherein the first light emission controlling sub-circuit and the second light emission controlling sub-circuit are configured to receive a first controlling signal, and supply the current for driving the light-emitting element to emit light to the first terminal of the light-emitting element under a control of the first controlling signal;

a driving controlling sub-circuit electrically coupled to the driving sub-circuit, and configured to receive a data signal and a second controlling signal, and supply the data signal to the driving sub-circuit under a control of the second controlling signal; and a resetting sub-circuit electrically coupled to the driving sub-circuit, and configured to receive a first voltage signal, a first resetting signal, and a second resetting signal, and reset the driving sub-circuit, the first terminal of the light-emitting element, and the second node with the first voltage signal under a control of the first resetting signal and the second resetting signal.

2. The pixel circuit of claim 1, wherein the driving sub-circuit comprises a driving transistor, a first transistor, and a storage capacitor, wherein:

a gate of the driving transistor is electrically coupled to a third node, a first electrode of the driving transistor is electrically coupled to the first node, and a second electrode of the driving transistor is electrically coupled to the second node;

a gate of the first transistor is electrically coupled to receive a third controlling signal, a first electrode of the first transistor is electrically coupled to the third node, and a second electrode of the first transistor is electrically coupled to the second node; and a first electrode of the storage capacitor is electrically coupled to receive a second voltage signal, and a second electrode of the storage capacitor is electrically coupled to the third node.

3. The pixel circuit of claim 2, wherein the resetting sub-circuit comprises a second transistor, a third transistor, and a fourth transistor, wherein:

a gate of the second transistor is electrically coupled to receive the first resetting signal, a first electrode of the second transistor is electrically coupled to receive the first voltage signal, and a second electrode of the second transistor is electrically coupled to the third node, a gate of the third transistor is electrically coupled to receive the second resetting signal, a first electrode of the third transistor is electrically coupled to receive the first voltage signal, and a second electrode of the third transistor is electrically coupled to a first terminal of the light-emitting element, and a gate of the fourth transistor is electrically coupled to receive the first resetting signal, a first electrode of the fourth transistor is electrically coupled to receive the first voltage signal, and a second electrode of the fourth transistor is electrically coupled to the second node.

4. The pixel circuit of claim 3, wherein the first light emission controlling sub-circuit comprises a fifth transistor, and the second light emission controlling sub-circuit comprises a sixth transistor, wherein:

a gate of the fifth transistor is electrically coupled to receive the first controlling signal, a first electrode of the fifth transistor is electrically coupled to receive the second voltage signal, and a second electrode of the fifth transistor is electrically coupled to the first node; and a gate of the sixth transistor is electrically coupled to receive the first controlling signal, a first electrode of the sixth transistor is electrically coupled to the second node, and a second electrode of the sixth transistor is electrically coupled to the first terminal of the light-emitting element.

5. A display panel including a plurality of pixel units, at least one of the plurality of pixel units comprising the pixel circuit of claim 4, wherein each of the at least one pixel unit comprises:

a substrate;

the first transistor, the third transistor, the fourth transistor, and the sixth transistor, each of which comprises:

an active layer comprising a first electrode area and a second electrode area, and a channel area between the first electrode area and the second electrode area;

a first insulating layer covering the active layer;

a gate layer disposed on the first insulating layer to be electrically insulated from the active layer; and a second insulating layer covering the gate layer and the first insulating layer;

a shield connection layer comprising a first shield line and a second shield line, the first shield line electrically connecting the second electrode area of the third transistor with the second electrode area of the sixth transistor, and the second shield line electrically connecting the second electrode area of the fourth transistor with the first electrode area of the sixth transistor, wherein at least one of the first and second shield lines has an orthographic projection on the substrate at least partially overlapping with an orthographic projection of the channel area of the first transistor on the substrate.

6. The display panel of claim 5, wherein:

the third transistor is formed with a first through hole penetrating the first insulating layer and the second insulating layer of the third transistor, so as to expose a part of the second electrode area of the third transistor;

the sixth transistor is formed with a second through hole and a third through hole penetrating the first insulating layer and the second insulating layer of the sixth transistor, so as to expose a part of the first electrode area of the sixth transistor and a part of the second electrode area of the sixth transistor, respectively; and the fourth transistor is formed with a fourth through hole penetrating the first insulating layer and the second insulating layer of the fourth transistor, so as to expose a part of the second electrode area of the fourth transistor, wherein the first shield line electrically connects the second electrode area of the third transistor with the second electrode area of the sixth transistor through the first through hole and the third through hole, and the second shield line electrically connects the second electrode area of the fourth transistor with the first electrode area of the sixth transistor through the second through hole and the fourth through hole.

7. The pixel circuit of claim 2, wherein the resetting sub-circuit comprises a second transistor and a third transistor, wherein:

a gate of the second transistor is electrically coupled to receive the first resetting signal, a first electrode of the second transistor is electrically coupled to receive the first voltage signal, and a second electrode of the second transistor is electrically coupled to the second node, a gate of the third transistor is electrically coupled to receive the second resetting signal, a first electrode of the third transistor is electrically coupled to receive the first voltage signal, and a second electrode of the third transistor is electrically coupled to the first terminal of the light-emitting element.

8. The pixel circuit of claim 7, wherein the first light emission controlling sub-circuit comprises a fifth transistor, and the second light emission controlling sub-circuit comprises a sixth transistor, wherein:

a gate of the fifth transistor is electrically coupled to receive the first controlling signal, a first electrode of the fifth transistor is electrically coupled to receive the second voltage signal, and a second electrode of the fifth transistor is electrically coupled to the first node; and a gate of the sixth transistor is electrically coupled to receive the first controlling signal, a first electrode of the sixth transistor is electrically coupled to the second node, and a second electrode of the sixth transistor is electrically coupled to the first terminal of the light-emitting element.

9. The pixel circuit of claim 1, wherein the driving controlling sub-circuit comprises a seventh transistor, wherein a gate of the seventh transistor is electrically coupled to receive the second controlling signal, a first electrode of the seventh transistor is electrically coupled to receive the data signal, and a second electrode of the seventh transistor is electrically coupled to the first node.

10. The pixel circuit of claim 1, wherein the resetting sub-circuit is configured to charge a voltage at the first node to a sum of a threshold voltage corresponding to the driving sub-circuit and a voltage of the first voltage signal, by using the first voltage signal.

11. The pixel circuit of claim 1, wherein the first resetting signal is the same as the second resetting signal.

12. The pixel circuit of claim 1, wherein the second resetting signal is the same as the first resetting signal being delayed by half a clock cycle.

13. A display panel, comprising:

a plurality of scanning lines;

a plurality of data lines, arranged to be intersected with the plurality of scanning lines; and a plurality of pixel units arranged at the intersections of respective data line and respective scanning line as a matrix, and electrically coupled to corresponding data line and corresponding scanning line, wherein each of the plurality of pixel units comprises the pixel circuit of claim 1, wherein the data signal received by the pixel circuit is supplied by the corresponding data line of the pixel unit, and the second controlling signal received by the pixel circuit is supplied by the corresponding scanning line of the pixel unit.

14. The display panel of claim 13, further comprising a plurality of light emission controlling lines arranged in parallel with the plurality of scanning lines or the plurality of data lines, and electrically coupled to the same pixel unit as the plurality of scanning lines or the plurality of data lines respectively, wherein the first controlling signal and a third controlling signal received by the pixel circuit are supplied by a corresponding light emission controlling line of the pixel unit.

15. The display panel of claim 13, wherein the first resetting signal and the second resetting signal received by the pixel circuit are supplied by a scanning line previous to a corresponding scanning line of the pixel unit in a scanning order.

16. A method for driving the pixel circuit of claim 1, comprising:

supplying, during a first period, the first controlling signal, the second controlling signal and a third controlling signal of a first level, and the first resetting signal and the second resetting signal of a second level;

supplying, during a second period, the first controlling signal, the first resetting signal, and the second resetting signal of the first level, and the second controlling signal and the third controlling signal of the second level, or the first controlling signal, the third controlling signal, the first resetting signal, and the second resetting signal of the first level, and the second controlling signal of the second level;

supplying, during a third period, the second controlling signal, the third controlling signal, the first resetting signal, and the second resetting signal of the first level, and the first controlling signal of the second level, or the second controlling signal, the first resetting signal, and the second resetting signal of the first level, and the first controlling signal and the third controlling signal of the second level.

17. The method of claim 16, wherein the voltage at the first node is charged to a sum of a threshold voltage corresponding to the driving sub-circuit and a voltage of the first voltage signal, by using the first voltage signal.

* * * * *